US011046339B2

(12) United States Patent
Richmond et al.

(10) Patent No.: US 11,046,339 B2
(45) Date of Patent: Jun. 29, 2021

(54) FRICTION END-OF-CAR CUSHIONING ASSEMBLY

(71) Applicant: TRINITY RAIL GROUP, LLC, Dallas, TX (US)

(72) Inventors: Shaun Richmond, Frankfort, IL (US); Matthew Gabriel Westlake, Maplewood, MN (US); Ricky Alleson Cribbs, Ovilla, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 202 days.

(21) Appl. No.: 16/502,659

(22) Filed: Jul. 3, 2019

(65) Prior Publication Data

US 2019/0337538 A1 Nov. 7, 2019

Related U.S. Application Data

(63) Continuation-in-part of application No. 15/901,484, filed on Feb. 21, 2018.

(60) Provisional application No. 62/473,165, filed on Mar. 17, 2017.

(51) Int. Cl.
*B61G 11/08* (2006.01)
*B61G 11/18* (2006.01)

(52) U.S. Cl.
CPC ..... *B61G 11/18* (2013.01); *B61G 11/08* (2013.01)

(58) Field of Classification Search
CPC ..... B61G 11/02; B61G 11/04; B61G 11/06; B61G 11/08; B61G 11/10; B61G 11/12; B61G 11/14; B61G 11/18; B61G 9/06; B61G 9/14; B61G 9/18; B61G 9/22
See application file for complete search history.

(56) References Cited

U.S. PATENT DOCUMENTS

| | | | | | |
|---|---|---|---|---|---|
| 2,414,222 | A * | 1/1947 | Dath | B61G 9/10 | 213/34 |
| 2,431,376 | A * | 11/1947 | Dath | B61G 11/14 | 213/221 |
| 2,687,220 | A * | 8/1954 | Danielson | B61G 9/06 | 213/34 |
| 2,720,320 | A * | 10/1955 | Dentler | B61G 9/04 | 213/45 |
| 2,982,426 | A * | 5/1961 | Mulcahy | B61G 11/18 | 213/221 |
| 4,645,187 | A * | 2/1987 | Kanjo | B61G 3/04 | 267/202 |
| 2019/0301559 | A1* | 10/2019 | Halavach | B61G 11/14 | |

* cited by examiner

*Primary Examiner* — Scott A Browne
(74) *Attorney, Agent, or Firm* — Baker Botts, LLP

(57) ABSTRACT

An assembly that includes a housing with a chamber formed within a bore of the housing. The assembly further includes a tapered center shaft disposed at least partially within the bore of the housing. The chamber includes an angled contact surface, a sliding wedge, and a load spring. The sliding wedge is positioned to apply a force onto the angled contact surface of the chamber. The sliding wedge is also positioned to apply a frictional force to a rod portion of the tapered center shaft. The load spring is compressed between a contact surface of the chamber and a contact surface of the sliding wedge. The load spring is positioned to apply a compressive force onto the contact surface of sliding wedge toward the angled contact surface of the chamber.

20 Claims, 14 Drawing Sheets

FRICTION END-OF-CAR CUSHIONING ASSEMBLY

CROSS REFERENCE TO RELATED APPLICATIONS

This application is a continuation-in-part of pending U.S. Non-Provisional patent application Ser. No. 15/901,484 filed Feb. 21, 2018 by Shaun Richmond, and entitled "Friction End-of-Car Cushioning Assembly," which claims benefit of U.S. Provisional Patent Application No. 62/473,165 filed Mar. 17, 2017 by Shaun Richmond, and entitled "Friction End-of-Car Cushioning Assembly" which are incorporated herein by reference as if reproduced in their entirety.

TECHNICAL HELP

This disclosure relates generally to railcars and, more particularly, to a railcar coupler system.

BACKGROUND

Railcars that carry sensitive lading, such as box cars, flat cars, and coil cars, require protection from the high impact forces that can develop when railcars are impacted into one another in classification yards. This protection is provided by two distinct types of "shock absorbing" devices. For railcars where the lading is not subject to damage, such as coal and grain cars, a short travel (e.g. less than 5") unit called a draft gear is used. These units predominantly use friction as a means of absorbing the energy of impact. When the lading is more likely to be damaged, such as consumer products, a longer travel unit (e.g. 10", 15", or 18") is used. These units are universally hydraulic and are referred to as an end-of-car cushioning (EOC) units. Hydraulic EOCs are excellent at protecting railcars and lading from impact damage. However, hydraulic EOCs tend to leak, are expensive, and their softness produces excessive train action forces in service. It is desirable to provide a solution that overcomes the problems associated with hydraulic EOCs while providing adequate protection for railcars and lading.

SUMMARY

In one embodiment, the disclosure includes a friction end-of-car cushioning (EOC) assembly with a housing coupled to a railcar. The housing has a chamber formed within a bore of the housing that includes a first contact surface comprising an angled contact surface at a first end of the chamber and a second contact surface at a second end of the chamber. The friction EOC assembly also includes a center shaft disposed at least partially within the bore of the housing. The center shaft has a head portion at a first end of the center shaft, a coupler interface at a second end of the center shaft, and a rod portion spanning between the head portion and the coupler interface. The rod portion of the center shaft is tapered from the second end of the center shaft to the first end of the center shaft.

The friction EOC assembly also includes a sliding wedge disposed within the chamber. The sliding wedge has a first contact surface tapered toward the first contact surface of the housing, a second contact surface perpendicular to the bore of the housing, and a third contact surface parallel to the bore of the housing. The sliding wedge is positioned to allow the rod portion of the center shaft to pass through a bore defined by the third contact surface of the sliding wedge. The sliding wedge is also configured such that the first contact surface of the sliding wedge is positioned to apply a force onto the angled contact surface of the housing and the third contact surface of the sliding wedge is positioned to apply a frictional force to the rod portion of the center shaft.

The friction EOC assembly also includes a load spring disposed within the chamber. The load spring is positioned to allow the rod portion of the center shaft to pass through a bore of the load spring. The load spring is compressed between the second contact surface of the chamber and the second contact surface of the sliding wedge and is positioned to apply a compressive force onto the second contact surface of sliding wedge toward the angled contact surface of the housing. The load spring is configured to not further compress as the center shaft moves within the bore of the housing.

In another embodiment, the disclosure includes a damping method that involves configuring a friction EOC assembly on a railcar in a first configuration. In the first configuration, a head portion of a center shaft is positioned adjacent to a chamber formed within a bore of a housing. The method further involves applying a force onto a coupler interface portion of the center shaft in a direction toward the first end of the chamber to transition the friction end-of-car cushioning assembly to a second configuration. Applying the force onto the center shaft moves the head portion of the center shaft away from the chamber and moves the coupler interface portion of the center shaft toward the chamber.

In yet another embodiment, the disclosure includes a damping method that involves configuring a friction EOC assembly on a railcar in a first configuration. In the first configuration, a coupler interface portion of a center shaft is positioned adjacent to a chamber formed within a bore of a housing. The method involves applying a force onto the coupler interface portion of the center shaft in a direction away the first end of the chamber to transition the friction end-of-car cushioning assembly to a second configuration. Applying the force onto the center shaft moves a head portion of the center shaft toward the chamber and moves the coupler interface portion of the center shaft away the chamber.

Disclosed herein are various embodiments of a friction EOC assembly for a railcar that provide several technical advantages. After a rapid rise in force, the force generated by the friction EOC assembly is essentially constant since the spring is pre-compressed and the compression on it does not change significantly during the stroke. In one embodiment, the friction EOC assembly is entirely mechanical and does not involve hydraulics, which allows the friction EOC assembly to be less expensive and more reliable than hydraulic EOCs. In one embodiment, the friction EOC assembly can be incorporated into a draft sill and does not require an additional housing, which may reduce weight und cost. The friction EOC assembly force levels can be adjusted by changing spring stiffness, spring pre-compression, and/or wedge angles. The friction EOC assembly design allows the friction EOC assembly to have any length of draft gear travel, and does not restrict travel of draft gear unlike existing systems.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Conventional friction draft gears use friction wedges backed by a spring that compresses as the draft gear is compressed. These types of friction draft gears cannot be extended to have significantly longer travel. As the spring is compressed, the spring applies a force on the wedges and the friction resisting compression of the draft gear increases. The force generated by these systems is a roughly linear increase of force with compression. However, the design of conventional draft gear limits its travel to about 4" to 5" due to the maximum practical compression of the spring. Conventional hydraulic end-of-car cushionings (EOCs) exhibit a rapid rise in force to an approximately constant level. This application of force allows hydraulic EOCs to absorb more energy than conventional friction draft gears. Hydraulic EOCs are more effective than even multiple friction draft gears in tandem.

Disclosed herein are various embodiments of a friction EOC assembly for a railcar. After a rapid rise in force, the force generated by the friction EOC assembly is essentially constant since the spring is pre-compressed and the compression on it does not change significantly during the stroke. In one embodiment, the friction EOC assembly is entirely mechanical and does not involve hydraulics, which allows the friction EOC assembly to be less expensive and more reliable than hydraulic EOCs. In one embodiment, the friction EOC assembly can be incorporated into a draft sill and does not require an additional housing, which may reduce weight and cost. The friction EOC assembly force levels can be adjusted by changing spring stiffness, spring pre-compression, and/or wedge angles. The friction EOC assembly design allows the friction EOC assembly to have any length of draft gear travel, and does not restrict travel of draft gear unlike existing systems.

In some embodiments, the friction EOC assembly can be used as a direct replacement for existing hydraulic EOCs. The friction EOC assembly may be configured to integrate with existing end fittings for hydraulic EOCs. For example, the friction EOC assembly may be configured with the same interface on the ends of the center shaft to allow the friction EOC assembly to be retrofitted to existing systems.

Figure 1:
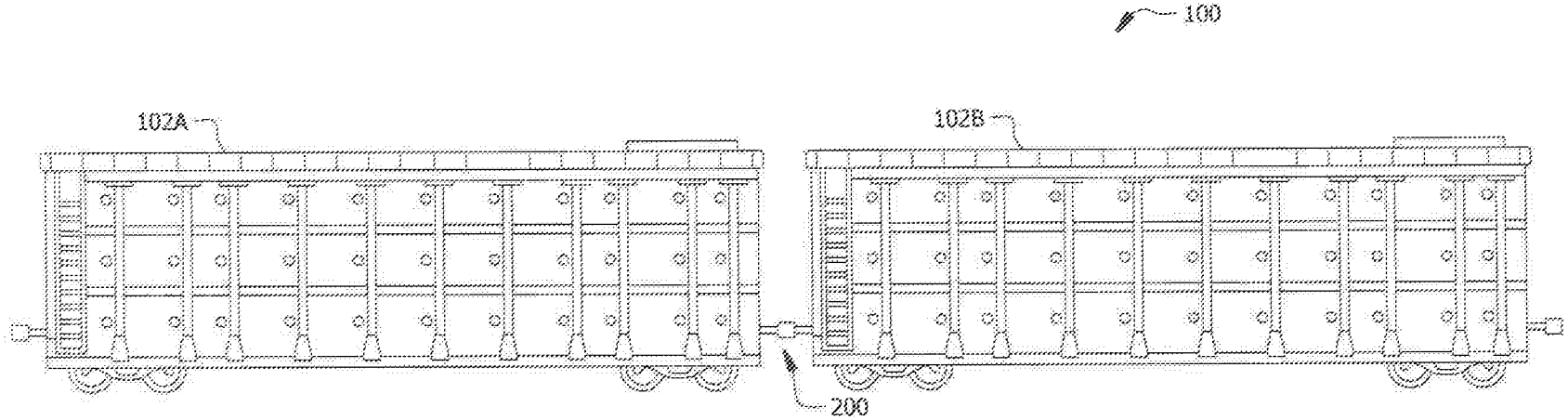
FIG. 1 is a side view of a railcar system using a friction end-of-car cushioning (EOC) assembly to couple railcars.

FIG. 1 is a side view of a railcar system 100 using a friction EOC assembly 200 to couple railcars 102A and 102B. Examples of railcars 102A and 102B include, but are not limited to, box cars, flat cars, autorack cars, tank cars, hopper cars, coil cars, or any other suitable type of railcar. The friction EOC assembly 200 is generally configured to protect railcars 102A and 102B and their payloads by dampening the high impact forces that can develop when the railcars 102A and 102B are impacted into one another. For example, the friction EOC assembly 200 may provide shock absorption when the railcars 102A and 102B are coupled to each other.

Figure 2:
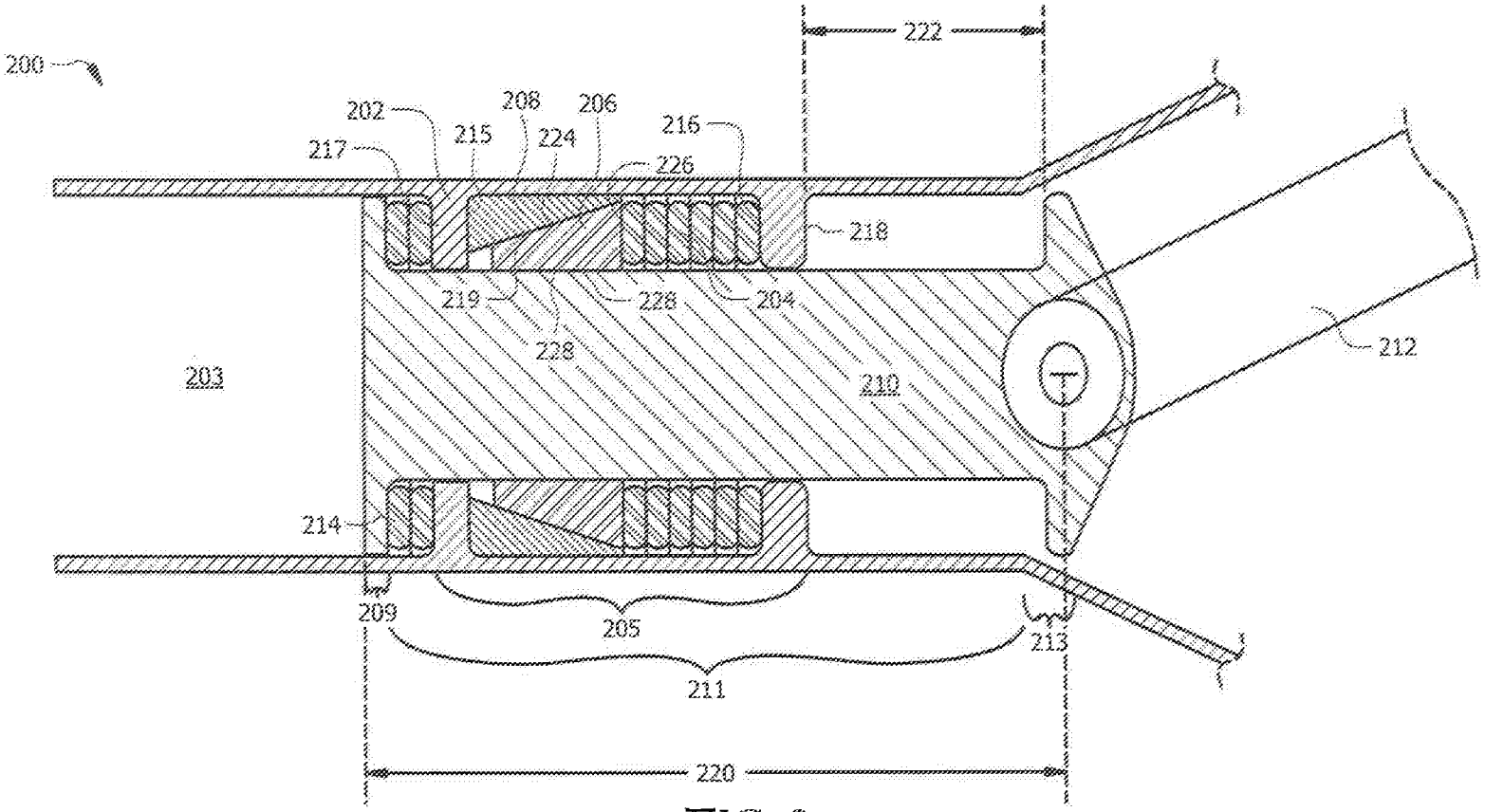
FIG. 2 is a cutaway view of an embodiment of a friction EOC assembly in a first configuration.

FIG. 2 is a cutaway view of an embodiment of a friction EOC assembly 200 in a first configuration. The friction EOC assembly 200 comprises a housing 202, a load spring 204, a sliding wedge 206, a backing wedge 208, a center shaft 210, a coupler 212, and a draft spring 214. The friction EOC assembly 200 may be configured as shown or in any other suitable configuration.

The housing 202 comprises an axial bore 203 that allows the center shaft 210 to move within the bore 203 of the housing 202. The housing 202 may be constructed using metals or any other suitable material. The housing 202 structure may be a square, circular, hexagonal, or any other suitable shape along the length of the housing 202. In other words, the housing 202 comprise a circular cross section, a rectangular cross section, a hexagonal cross section, or any other suitable shape cross section. In one embodiment, the housing 202 is supported by a draft stop welded to the draft sill, which allows the housing 202 to remain in a fixed position as the center shaft 210 slides through the housing 202.

The center shaft 210 comprises a head portion 209, a rod portion 211, and a coupler interface portion 213. The head portion 209 is located at a first end of the center shaft 210. The coupler interface portion 213 is located at a second end of the center shaft 210. The rod portion 211 spans between the head portion 209 and the coupler interface portion 213 of the center shaft 210. The rod portion 211 comprise a circular cross section, a rectangular cross section, or any other suitable shape cross section. In one embodiment, the head portion 209 and/or the coupler interface portion 213 have a circumferential diameter larger than the diameter of the rod portion 211 of the center shaft 210. The coupler interface portion 213 of the center shaft 210 is coupled to a coupler 212 which may be used to connect a railcar with the friction EOC assembly 200 to another railcar. The coupler 212 may be any suitable type of coupler for connecting railcars.

The center shaft 210 is disposed at least partially within the bore 203 of the housing 202. The center shaft 210 is positioned such that at least a portion (e.g. the rod portion 211) of the center shaft 210 passes through the chamber 205 of the housing 202. In FIG. 2, the center shaft 210 is shown in an extended position, such that the center shaft 210 is extending in a direction out of the housing 202 and toward the coupler 212. The center shaft 210 is configured to move (e.g. slide) within the bore 203 of the housing 202.

The center shaft 210 may have any suitable length 220 and/or stroke length 222. For example, the center shaft 210 may have a length 220 of about 30 inches (in) and a stroke length 222 of about 10 in. In other examples, the center shaft 210 may be any other suitable length 220 and/or stroke length 222. The center shaft 210 structure may be a square, circular, hexagonal, or any other suitable shape along the length of the center shaft 210.

The housing 202 comprises a chamber 205 configured to house the loud spring 204, the sliding wedge 206, and the backing wedge 208. The chamber 205 is formed within the bore 203 of the housing 201. The chamber 205 is configured to allow a rod portion 211 of the center shaft 210 to pass through an opening or bore formed by the chamber 205.

The backing wedge 208 is disposed within the chamber 205 such that at least a portion of the backing wedge 208 is in contact with a first contact surface 215 at a first end of the chamber 205. The backing wedge 208 comprises on angled contact surface 219. The angled contact surface 219 is a surface that tapers away from the first end of the chamber 205. The angled contact surface 219 may have suitable angle or rate of tapering. The backing wedge 208 is positioned to allow the rod portion 211 of the center shaft 210 to pass through a bore or opening defined by the angled contact surface 219 of the backing wedge 208.

The sliding wedge 206 is disposed within the chamber 205. The sliding wedge 206 comprises a first contact surface 224 tapered toward the first contact surface 215 of the chamber 205. The first contact surface 224 of the sliding wedge 206 is positioned to apply a force (e.g. a compressive force and/or a frictional force) onto the angled contact surface 219 of the backing wedge 208. The sliding wedge 206 comprises a second contact surface 226 configured substantially perpendicular to the bore 203 of the housing 202. The sliding wedge 206 comprises a third contact surface 228 configured substantially parallel to the bore 203 of the housing 202. The sliding wedge 206 is positioned to allow the rod portion 211 of the center shaft 210 to pass through a bore or opening defined by the third contact surface 228 of the sliding wedge 206. In addition, the third contact surface 228 is at least partially in contact with the rod portion 211 of the center shaft 210 and is positioned to apply a frictional force onto the rod portion 211 of the center shaft 210.

The load spring 204 is disposed within the chamber 205. Examples of the load spring 204 include, but are not limited to, coil springs, elastomer springs, and rubber dampeners. The load spring 204 is portioned to allow the rod portion 211 of the center shaft 210 to pass within a bore or opening defined by the loud spring 204. The load spring 204 is configured to be pre-compressed within the chamber 205. The load spring 204 is compressed between a second contact surface 216 at a second end of the chamber 205 and the second contact surface 226 of the sliding wedge 206. In such a configuration, the load spring 204 is configured to apply a compressive force to the second contact surface 226 of the sliding wedge 206 toward the angled contact surface 219 of the backing wedge 208.

Unlike conventional friction draft gears which use a spring that is initially unloaded, the load spring 204 is configured to be preloaded (i.e. pre-compressed) which constantly applies a force to the sliding wedge 206. Although the load spring 204 is shown as an elastomeric spring, the load spring 204 may be any other suitable type of spring or mechanism. The force applied to the end of the sliding wedge 206 causes the sliding wedge 206 to apply a force to both the angled contact surface 219 of the backing wedge 208 and the rod portion 211 of the center shaft 210. The force applied to the center shaft 210 by the sliding wedge 206 results in friction between the center shaft 210 and the sliding wedge 206. In one embodiment, the load spring 204 is configured to not further compress as the center shaft 210 moves within the bore 203 of the housing 202. In other words, the compression of the load spring 204 remains substantially constant when the center shaft 210 moves within the bore 203 of the housing 202.

In one embodiment, the friction EOC assembly 200 comprises a draft spring 214 disposed within the housing 102. Examples of the draft spring 214 include, but are not limited to, coil springs, elastomer springs, and rubber dampeners. The draft spring 214 is positioned between the head portion 209 of the center shaft 210 and a third contact surface 217 at the first end of the chamber 205. The draft spring 214 is configured such that the rod portion 211 of the center shaft 210 passes through the draft spring 214. The draft spring 214 is configured to provide cushioning to the center shalt 210 by applying a force to the head portion 209 of the center shaft 210 when the center shaft 210 extends out of the housing 202. Without the draft spring 214, the head portion 209 of the center shaft 210 would make contact with the third contact surface 217 of the chamber 205 which would cause the center shaft 210 to stop abruptly at full travel. Although the draft spring 214 is shown as an elastomeric spring, the draft spring 214 may be any other suitable type of spring or mechanism. In some embodiments, the draft spring 214 is optional.

Figure 3:
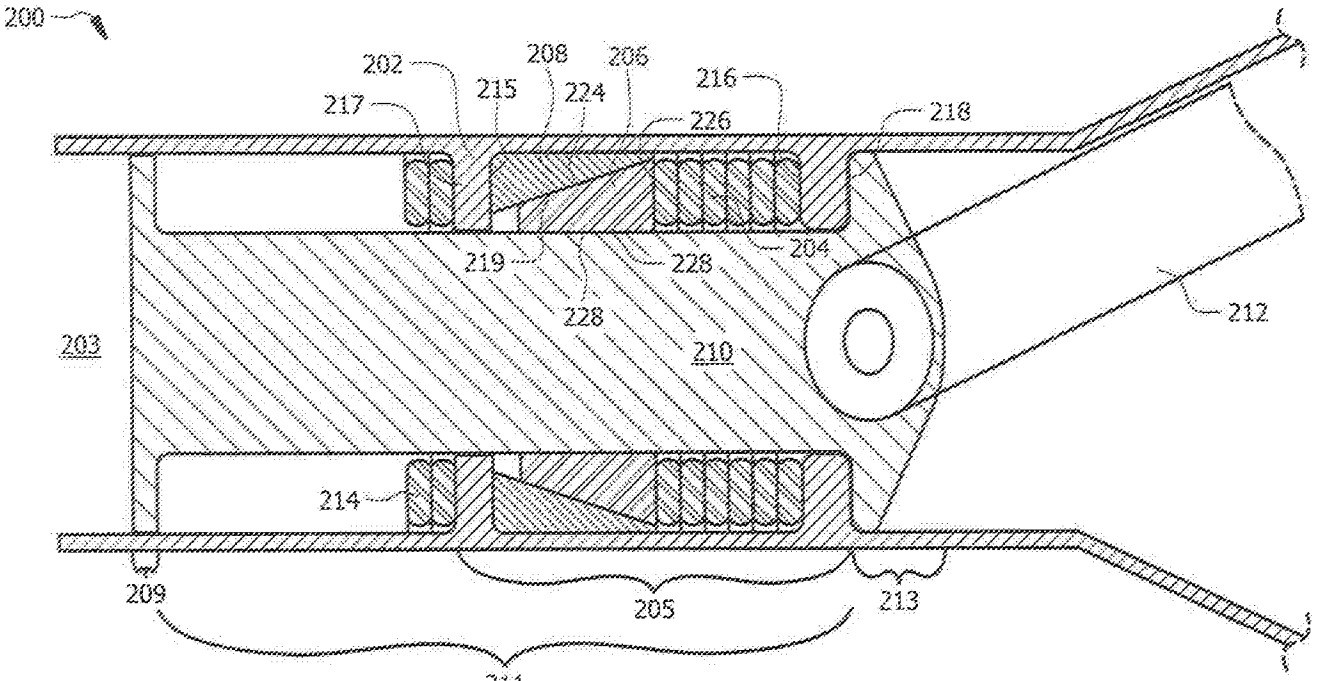
FIG. 3 is a cutaway view of an embodiment of the friction EOC assembly in a second configuration.

FIG. 3 is a cutaway view of an embodiment of the friction EOC assembly 200 in a second configuration. In FIG. 3, the center shaft 210 is shown in a retracted position, such that the center rod 200 is retracted into the housing 202. During an impact event, the center shaft 210 is pushed into the housing 202. The load spring 204 constantly applies a force to the second contact surface 226 of the sliding wedge 206, which pushes the sliding wedge 206 down the slope of the angled contact surface 219 of the backing wedge 208 between the center shaft 210 and the backing wedge 208. This produces a magnified normal force between the sliding wedge 206 and the center shaft 210. This force resists the motion of the center shaft 210 and absorbs the energy of impact. The motion of the center shaft 210 also enhances the wedge action and further increases the force.

Figure 4:
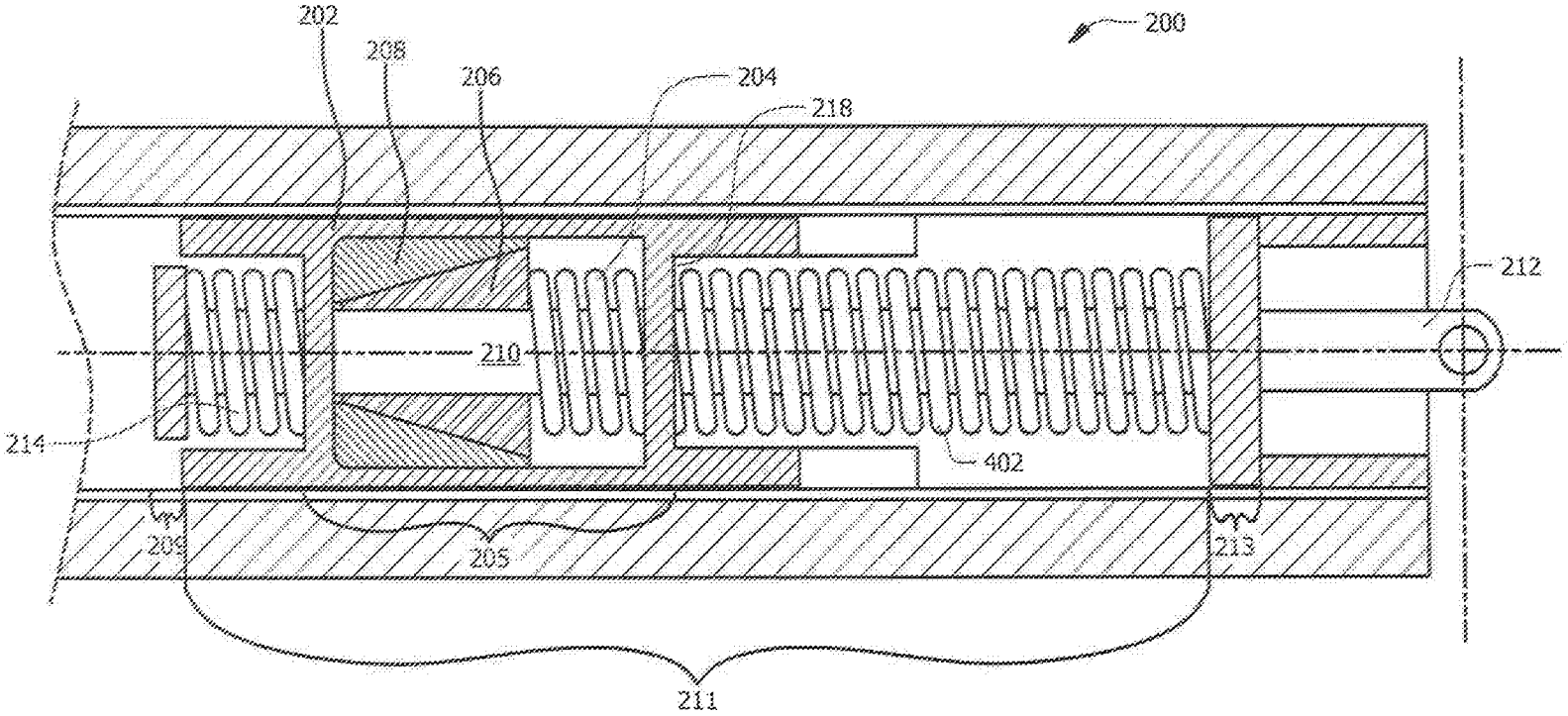
FIG. 4 is a cutaway view of another embodiment of a friction EOC assembly.

FIG. 4 is a cutaway view of another embodiment of a friction EOC assembly 200. In one embodiment, the friction EOC assembly 200 comprises a return spring 402 disposed within the housing 202. Examples of the return spring 402 include, but are not limited to, coil springs, elastomer springs, and rubber dampeners. The return spring 402 is positioned between the coupler interface 213 and a fourth contact surface 218 at the second end of the chamber 205.

The return spring 402 is configured to allow the rod portion 211 of the center shaft 210 to pass through the return spring 402. The return spring 402 is configured such that when a force is no longer pushing the center shaft 210 into the housing 202, the return spring 402 pushes the center shaft 210 back into the extended position, for example, as shown in FIG. 1. Although the return spring 402 is shown as a coil spring, the return spring 402 may be any other suitable type of spring or mechanism. In some embodiments, the return spring 402 is optional.

Figure 5:
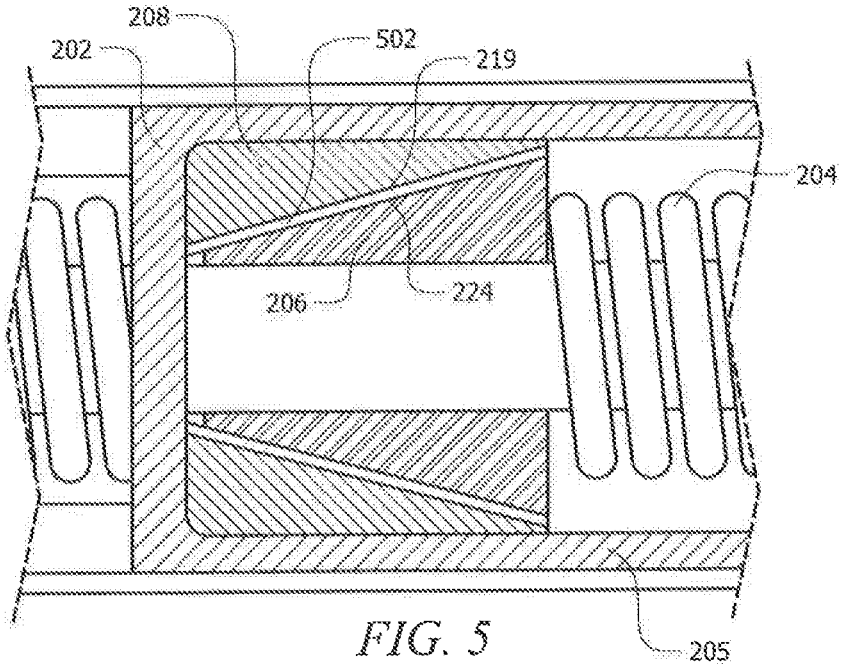
FIG. 5 is partial cutaway view of an embodiment of a wedge configuration for the friction EOC assembly.

FIG. 5 is partial cutaway view of an embodiment of a wedge configuration for the friction EOC assembly 200. In one embodiment, the friction EOC assembly 200 comprises a spring or an elastomer liner 502 between the first contact surface 224 of the sliding wedge 106 and the angled contact surface 219 of the backing wedge 108. In this configuration, the friction EOC assembly 200 is configured such that the sliding wedge 206 and the backing wedge 208 do not slide past each other. The elastomer liner 502 is configured to deflect in shear, which allows motion for the sliding wedge 206. Such a configuration may be more consistent than only relying on friction. In one embodiment, the elastomer liner 502 could also represent a low friction lining material between the sliding wedge 206 and the backing wedge 208. In this configuration, the low friction between the sliding wedge 206 and the backing wedge 208 may produce more consistent and lower friction which may enhance the operation of the sliding wedge 206.

Figure 6:
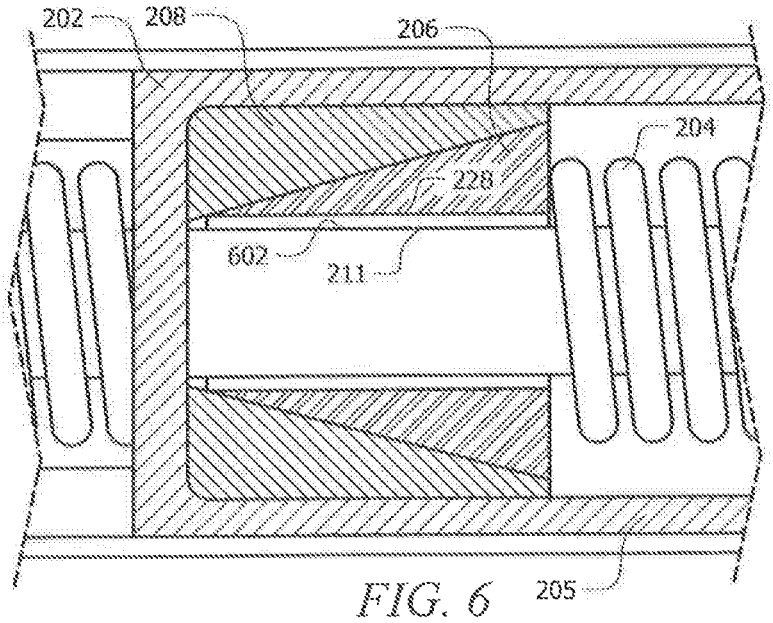
FIG. 6 is partial cutaway view of another embodiment of a wedge configuration for the friction EOC assembly.

FIG. 6 is partial cutaway view of another embodiment of a wedge configuration for the friction EOC assembly 200. In one embodiment, the friction EOC assembly 200 comprises an insert 602 between the third contact surface 228 of the sliding wedge 206 and lite rod portion 211 of the center shaft 210. The insert 602 may be a sliding material such as a brake lining material which could provide improved friction characteristics. In some embodiments, the insert 602 may be produced by inserting slugs of lubrication material onto slots in the faces (e.g. the third contact surface 228) of the sliding wedge 206 and the rod portion 211 of the center shaft 210. In this example, the lubrication material is spread over the surface as the center shaft 210 slides to form the insert 602.

Figure 7:
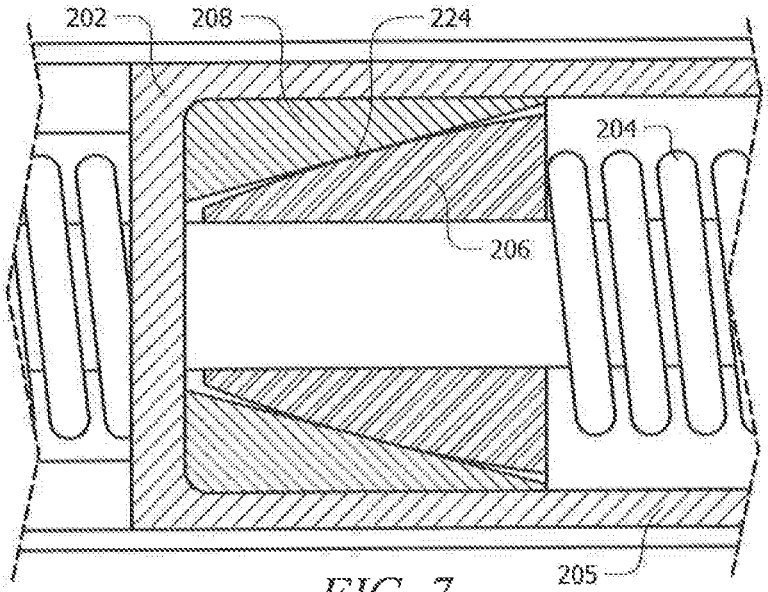
FIG. 7 is partial cutaway view of another embodiment of a wedge configuration for the friction EOC assembly.

FIG. 7 is partial cutaway view of another embodiment of a wedge configuration for the friction EOC assembly 200. In one embodiment, the first contact surface 224 of the sliding wedge 206 has a rounded surface. For example, the sliding wedge 206 may be configured such that first contact surface 224 of the sliding wedge 206 has a curved or rounded surface. The first contact surface 224 of the sliding wedge 206 may have any suitable amount of curvature or roundedness. The curvature of the sliding wedge 206 may allow the sliding wedge 206 to properly align with the center shaft 210 even if the backing wedge 208 is not at exactly the correct angle or is not flat. Properly aligning the center shaft 210 may help the friction EOC assembly 200 generate more force for absorbing energy.

Figure 8:
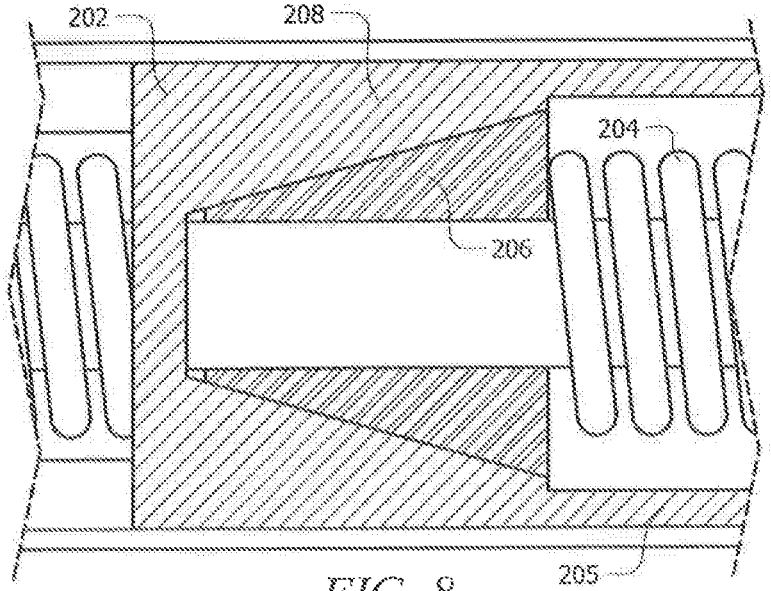
FIG. 8 is partial cutaway view of another embodiment of a wedge configuration for the friction EOC assembly.

FIG. 8 is partial cutaway view of another embodiment of a wedge configuration for the friction EOC assembly 200. In one embodiment, the backing wedge 208 is formed by the chamber 205. In other words, an interior portion of the chamber is configured to serve as the previously described backing wedge 208.

Figure 9:
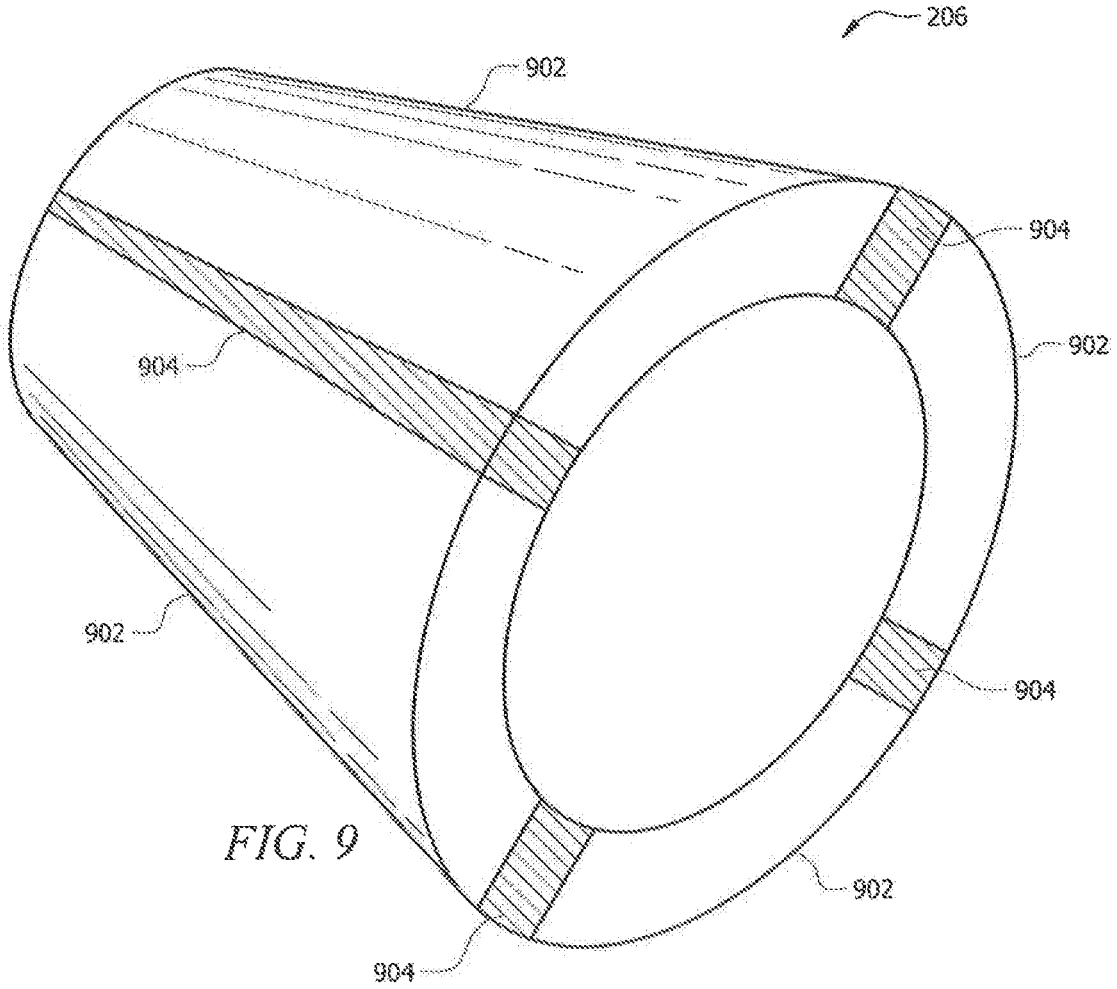
FIG. 9 is partial cutaway view of another embodiment of a wedge configuration for the friction EOC assembly.

FIG. 9 is partial cutaway view of another embodiment of a wedge configuration for the friction EOC assembly 200. In one embodiment, the backing wedge 208 is configured into a cone shape. The sliding wedge 106 is configured to be curved and to fit within the cone shape structure of the backing wedge 208.

In one embodiment, the sliding wedge 206 comprises a plurality of sliding wedge segments 902 and a plurality of elastomer lining segments 904. Each of the plurality of elastomer lining segments 904 may be disposed between a pair of sliding wedge segments 902 from the plurality of sliding wedge segments 902. In this example, the sliding wedges 902 are evenly spaced by inserting a soft elastomer 904 between the sliding wedges 902. The sliding wedge 206 may comprise any suitable number of sliding wedge segments 902 and/or elastomer lining segments 904. In addition, the elastomer lining segments 904 may have any suitable thickness.

Figure 10:
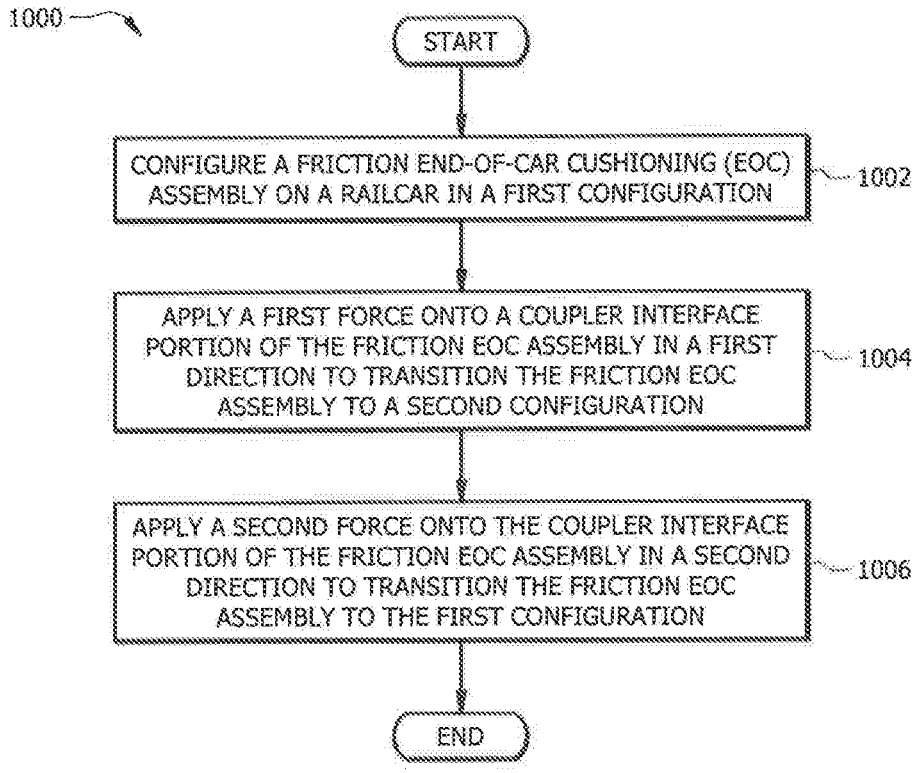
FIG. 10 is an embodiment of a damping method using a friction EOC assembly.

FIG. 10 is an embodiment of a damping method 1000 using a friction EOC assembly 200. An operator may employ method 1000 with the friction EOC assembly 200 to provide shock absorption when connecting two railcars together.

At step 1002, an operator configures the friction EOC assembly 200 on a railcar in a first configuration. In the first configuration, the friction EOC assembly 200 may be configured with the center shaft 210 positioned similar to the configuration shown in FIG. 2.

At step 1004, a first force is applied onto the coupler interface portion 213 of the center shaft 210 in a first direction toward the first end of the chamber 205 to transition the friction EOC assembly 200 to a second configuration. For example, as the railcars begin to engage each other, the coupler 212 attached to the coupler interface portion 213 of the center shaft 210 may experience a force that moves the coupler interface portion 213 of the center shaft 210 toward the chamber 205 and moves the head portion 209 of the center shaft 210 away the chamber 205. In the second configuration, the friction EOC assembly 200 may be configured with the center shaft 210 positioned similar to the configuration shown in FIG. 3.

At step 1006, a second force is applied onto the coupler interface portion 213 of the center shaft 210 in a second direction away from the first end of the chamber 205 to transition the friction EOC assembly 200 back to the first configuration. For example, as the railcars begin to separate from each other, the coupler 212 attached to the coupler interface portion 213 of the center shaft 210 may experience a force that moves the coupler interface portion 213 of the center shaft 210 away the chamber 205 and moves the head portion 209 of the center shaft 210 toward the chamber 205. In one embodiment, the second force is applied to the coupler interface portion 213 of the center shaft 210 by a return spring (e.g. return spring 402). In another embodiment, the second force is applied to the coupler interface portion 213 of the center shaft 210 by the coupler 212 pulling away from the friction EOC assembly 200. In other embodiments, the second force is applied to the coupler interface portion 213 of the center shaft 210 by any other suitable method as would be appreciated by one of ordinary skill in the art upon viewing this disclosure.

Figure 11:
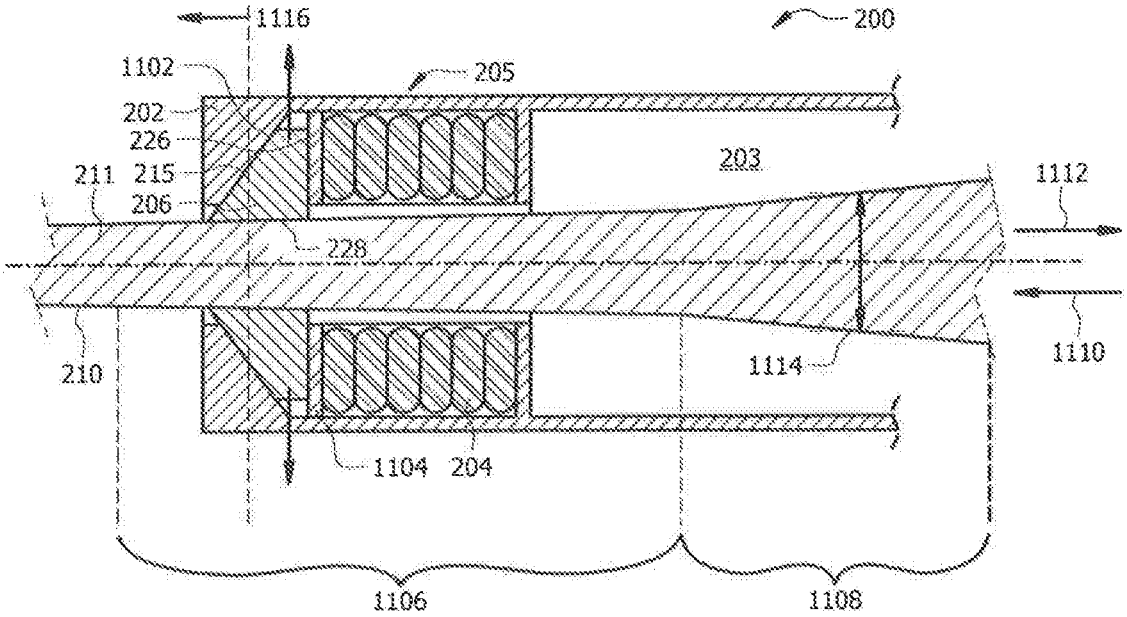
FIG. 11 is a partial cutaway view of a portion of another embodiment of a friction EOC assembly in a first configuration.

FIG. 11 is a partial cutaway view of a portion of another embodiment of a friction EOC assembly 200 in a first configuration. In FIG. 11, the diameter 1114 of the rod portion 211 of the center shaft 210 is tapered in a direction from the coupler interface portion 213 at the second end of the center shaft 210 to the head portion 209 at the first end of the center shaft 210. The tapering of the rod portion 211 of the center shaft 210 causes the diameter 1114 of the center shaft 210 to vary along the length of the rod portion 211 of the eerier shaft 210. In some embodiments, the rod portion 211 of the center shaft 210 may be configured such that different portions of the center shaft 210 have different tapering rates. For example, the rod portion 211 of the center shaft 210 may comprise a first tapered portion 1106 and a second tapered portion 1108. In this example, the first tapered portion 1106 may taper at a greater rate than the second tapered portion 1108. In other words, the diameter 1114 of the first tapered portion 1106 may reduce more rapidly than the diameter 1114 of the second tapered portion 1108. The tapering of the center shaft 210 effectively causes the diameter 1114 of the center shaft 210 to increase as the center shaft 210 moves in the first direction 1110. This causes the closing force of the friction EOC assembly 200 to increase which allows for a less abrupt slowing of a railcar under low velocity impacts and a higher force under high velocity impacts. The center shaft 210 may have a cross section that is a rectangular, circular, hexagonal, or any other suitable shape along the length of the center shaft 210.

Figure 12:
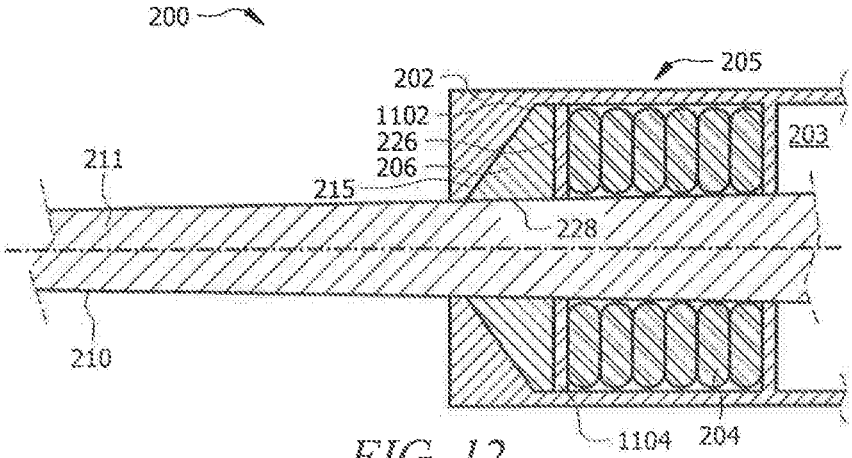
FIG. 12 is a partial cutaway view of a portion of another embodiment of a friction EOC assembly in a second configuration.

In FIG. 11, the previously described backing wedge 208 may be integrated within the chamber 205 of the housing 202. For example, the chamber 205 may comprise an angled contact surface 1102 that operates similar to the backing wedge 208 described in FIG. 2. In the first configuration, the sliding wedge 206 is configured to move along the angled contact surface 1102 as the center shaft 210 traverses the bore 203 of the housing 202. As the center shaft 210 traverses the bore 203 of the housing 202 in a first direction 1110, the diameter 1114 of the rod portion 211 of the center shaft 210 that passes through the sliding wedge 206 increases. The increasing diameter 1114 of the center shaft 210 causes the sliding wedge 206 move or expand outwardly toward the sidewalls of the housing 202. An example of the sliding wedge 206 moving outwardly toward the sidewalls of the housing 202 is shown in FIG. 12. As the center shaft 210 traverses the bore 203 of the housing 202 in a second direction 1112, the diameter 1114 of the rod portion 211 of the center shaft 210 that passes through the sliding wedge 206 decreases. The decreasing diameter 1114 of the center shaft 210 causes the sliding wedge 206 move or contract inwardly toward the bore 203 of the housing 202.

In one embodiment, the friction EOC assembly 200 may comprise a spring seat or backing plate 1104 disposed between the sliding wedge 206 and the load spring 204. In this configuration, the load spring 204 is configured to apply a force onto the sliding wedge 206 via the spring seal 1104.

FIG. 12 is a partial cutaway view of a portion of another embodiment of a friction EOC assembly 200 in a second configuration. In the second configuration, the sliding wedge 206 has moved or expanded outwardly toward the sidewalls of the housing 202. In this configuration, the normal force between the sliding wedge 206 and the center shaft 210 is magnified. This force resists the motion of the center shaft 210 and absorbs the energy of an impact. The motion of the center shaft 210 also enhances the wedge action between the sliding wedge 206 and the angled contact surface 1102 of the housing 202 which further increases the resistive force.

Figure 13:
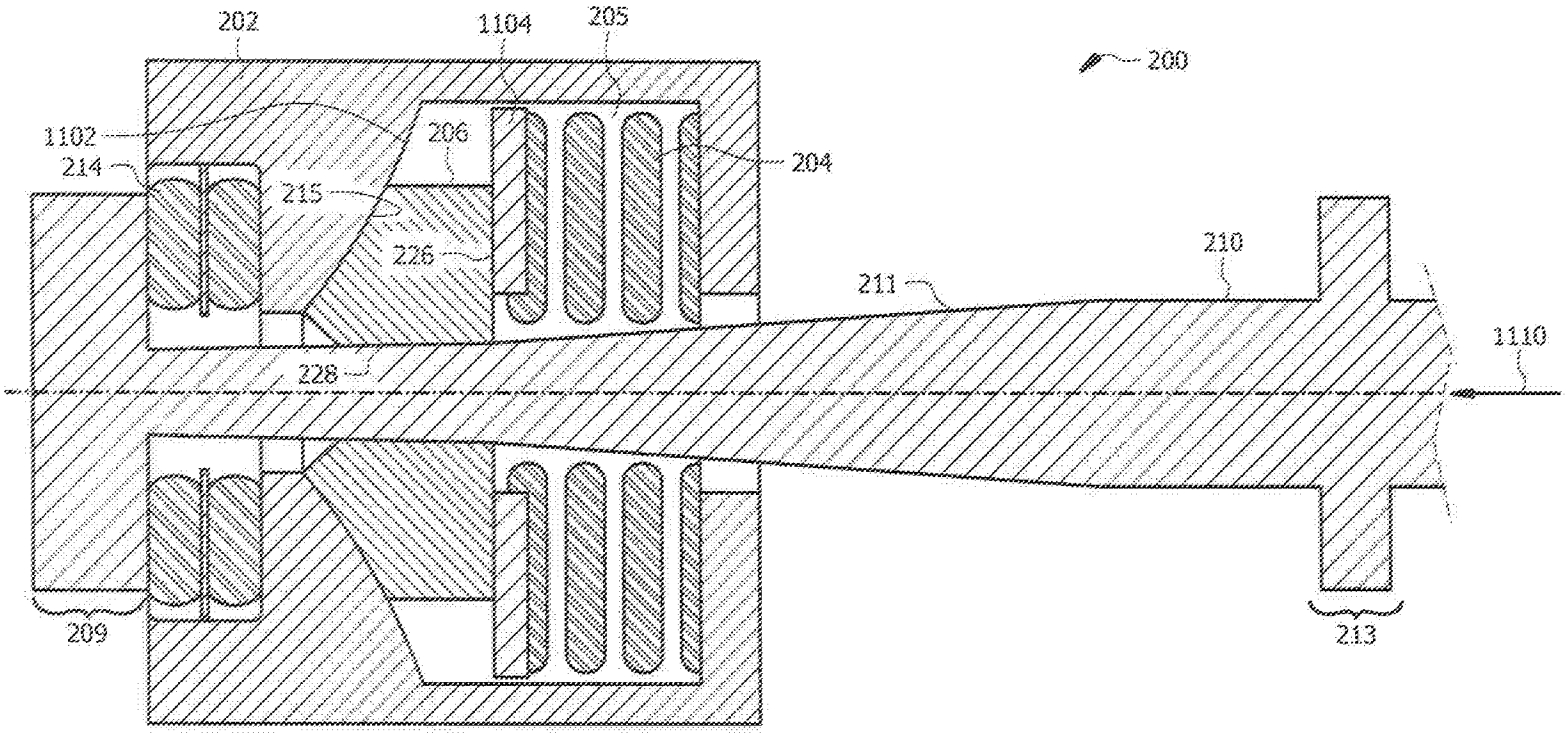
FIG. 13 is a partial cutaway view of another embodiment of a friction EOC assembly.

FIG. 13 is a partial cutaway view of another embodiment of a friction EOC assembly 200. In FIG. 13, the angled contact surface 1102 of the housing 202 is curved toward the sliding wedge 206. In addition, the first contact surface 215 of the sliding wedge 206 is curved away from the angled contact surface 1102 of the housing 202 to substantially match the curvature of the angled contact surface 1102 of the housing 202. The angled contact surface 1102 of the housing 202 and the first contact surface 215 of the sliding wedge 206 may each have any suitable amount of curvature or roundness. The curvature of the angled contact surface 1102 of the housing 202 and the first contact surface 215 of the sliding wedge 206 may prevent or mitigate the ends of the sliding wedge 206 from rotating against the angled contact surface 1102 of the housing 202.

In one embodiment, the third contact surface 228 of the sliding wedge 206 may be curved toward the center shaft 210. The curvature of the third contact surface 228 of the sliding wedge 206 may allow the amount of friction and force between the sliding wedge 206 and the center shaft 210 to vary as the center shaft 210 traverses the bore 203 of the housing 202.

In some embodiments, one of the angled contact surface 1102 or the first contact surface 215 of the sliding wedge 206 may be curved while the other contact surface remains flat. For example, the angled contact surface 1102 may be flat while the first contact surface 215 of the sliding wedge 206 is curved. In this example, the first contact surface 215 of the sliding wedge 206 may be curved in a direction toward the angled contact surface 1102. In this configuration, the point of contact between the angled contact surface 1102 and the first contact surface 215 of the sliding wedge 206 moves outward as the sliding wedge 206 rotates when the center shaft 210 traverses the bore 203 of the housing 202.

FIGS. 14-18 are cross-sectional views of examples of different configurations for sliding wedge segments 206 within the housing 202 of friction EOC assembly 200. As an example, the cross-sectional views may be from location 1116 shown in FIG. 11. In FIGS. 14-18, the housing 202 has a rectangular cross section that comprises four edges 1402 (e.g. sidewalls) and four corners 1404. In this example, the center shaft 210 also has a rectangular cross section that comprises four edges 1406 and four corners 1408. The sliding wedge segments 206 may be configured to be in different shapes and/or positions within the housing 202. FIGS. 14-18 illustrate examples with four sliding wedge segments 206. In other examples, the friction EOC assembly 200 may comprise any other suitable number of sliding wedge segments 206.

Figure 14:
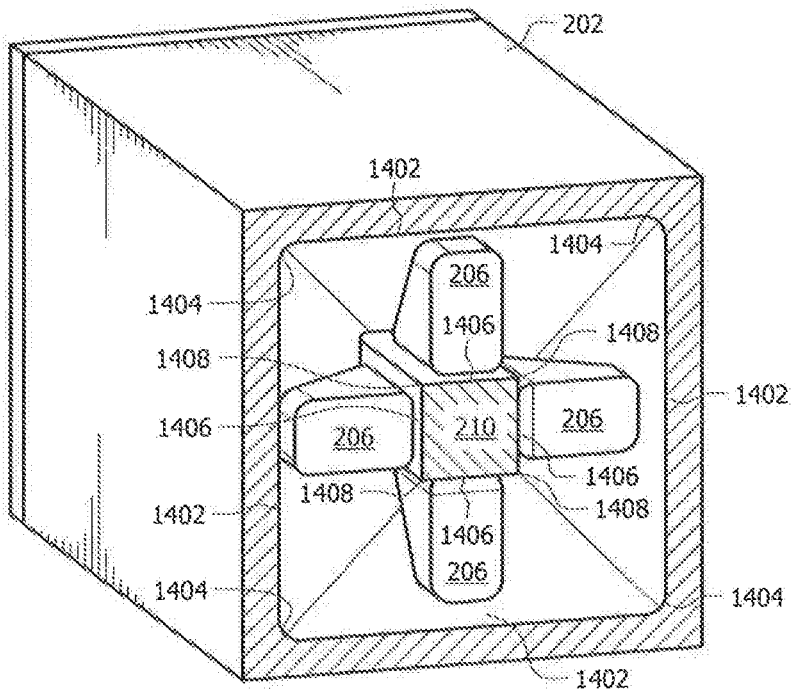
FIG. 14 is a cross section view of an embodiment of sliding wedge segments within the housing of a friction EOC assembly.

FIG. 14 is a cross section view of an embodiment of sliding wedge segments 206 within the housing of a friction EOC assembly 200. In FIG. 14, each sliding wedge segment 206 has a rectangular cross section and is configured to apply a force to an edge 1402 of the housing 202 and an edge 1406 of the center shaft 210.

Figure 15:
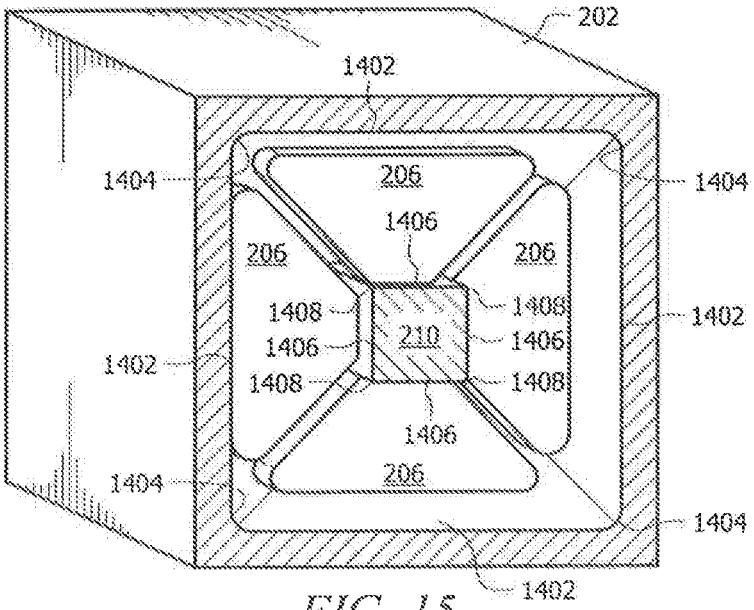
FIG. 15 is a cross section view of another embodiment of sliding wedge segments within the homing of a friction EOC assembly.

FIG. 15 is a cross section view of another embodiment of sliding wedge segments 206 within the housing of a friction EOC assembly 200. In FIG. 15, each sliding wedge segment 206 has a trapezoidal cross section and is configured to apply a force to an edge 1402 of the housing 202 and an edge 1406 of the center shaft 210. In this configuration, the sliding wedge segments 206 have a larger contact surface with the edge 1402 of the housing 202 compared to the sliding wedge segment 206 configuration described in FIG. 14. The larger contact surface provides increased stiffening of the housing 202 against frictional forces.

Figure 16:
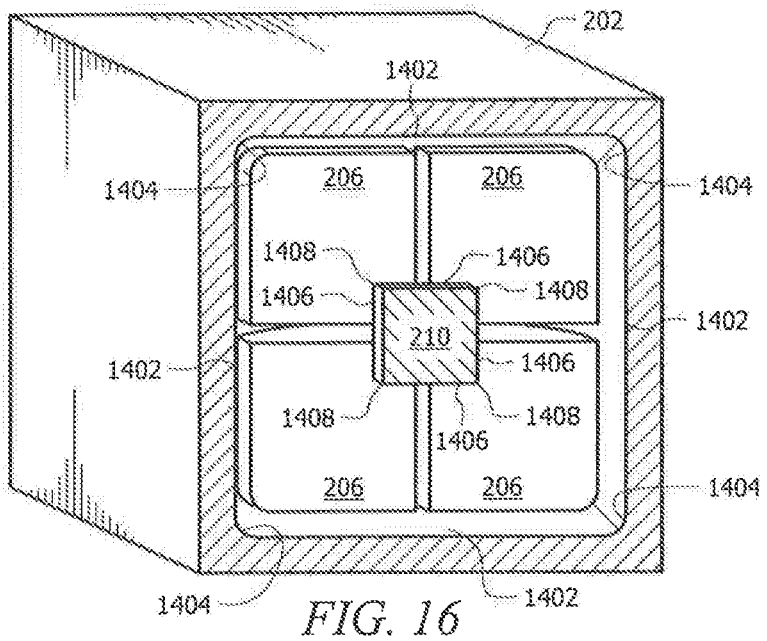
FIG. 16 is a cross section view of another embodiment of sliding wedge segments within the housing of a friction EOC assembly.

FIG. 16 is a cross section view of another embodiment of sliding wedge segments 206 within the housing of a friction EOC assembly 200. In FIG. 16, each sliding wedge segment 206 has a rectangular cross section and is configured to apply a force to two edges 1402 and a corner 1404 of the housing 202 and two edges 1406 and a corner 1408 of the center shaft 210. In this configuration, the corners 1404 of the housing 202 and the corners 1408 of the center shaft 210 may act as guides for the sliding wedge segments 206.

Figure 17:
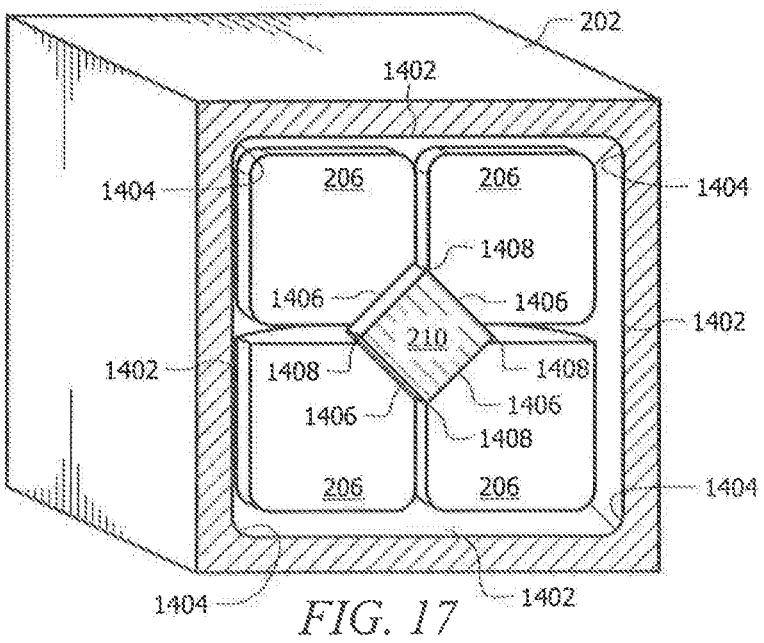
FIG. 17 is a cross section view of another embodiment of sliding wedge segments within the housing of a friction EOC assembly.

FIG. 17 is a cross section view of another embodiment of sliding wedge segments 206 within the housing of a friction EOC assembly 200. In FIG. 17, each sliding wedge segment 206 has a rectangular cross section and is configured to apply a force to two edges 1402 and a corner 1404 of the housing 202 and an edge 1406 of the center shaft 210. In this configuration, the center shaft 210 is rotated 45 degrees from the example shown in FIG. 16.

Figure 18:
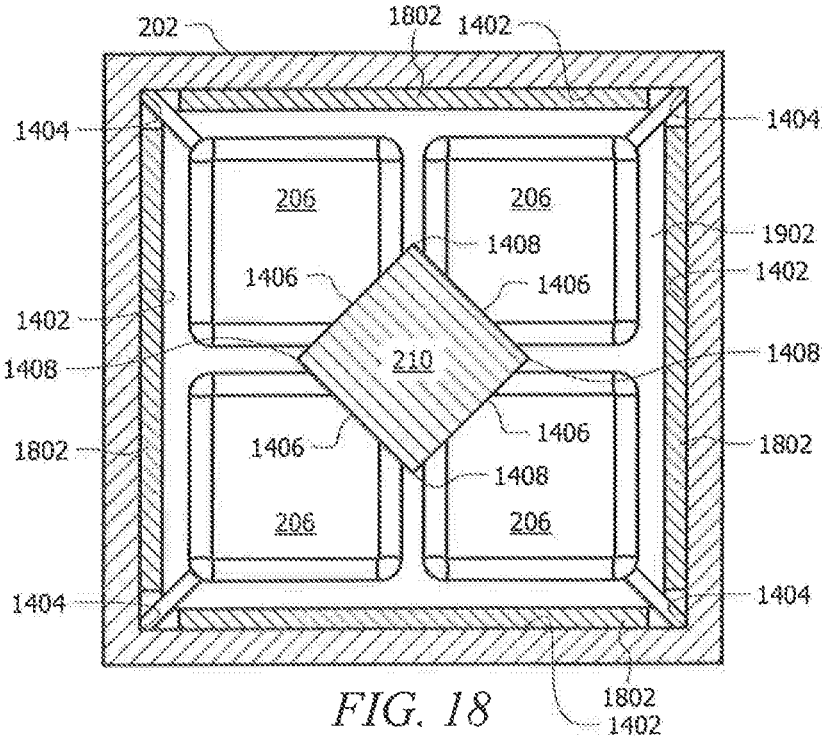
FIG. 18 is a cross section view of another embodiment of sliding wedge segments within the housing of a friction EOC assembly.

FIG. 18 is a cross section view of another embodiment of sliding wedge segments within the housing of a friction EOC assembly 200. In FIG. 18, each sliding wedge segment 206 has a rectangular cross section and is configured to apply a force to two edges 1402 and a corner 1404 of the housing 202 and on edge 1406 of the center shaft 210. In this configuration, the friction EOC assembly 200 further comprises a low modulus material 1802 disposed between the sliding wedge segments 206 and the housing 202. In one embodiment, the low modulus material 1802 has an elastic modulus that is less than steel. Examples of the low modulus material 1802 include, but are not limited to, a polymer material, a hard rubber, rubber, urethane, and any other suitable type of material. The low modulus material 1802 may be formed to be any suitable shape or thickness. An expansion force is applied to the housing 202 as the sliding wedge segments 206 move along the angled contact surface 1102 of the housing 202. The low modulus material 1802 provides increased stiffening to the sidewalk housing 202 to mitigate any expansion of the housing 202 due to the expansion force.

Figure 19:
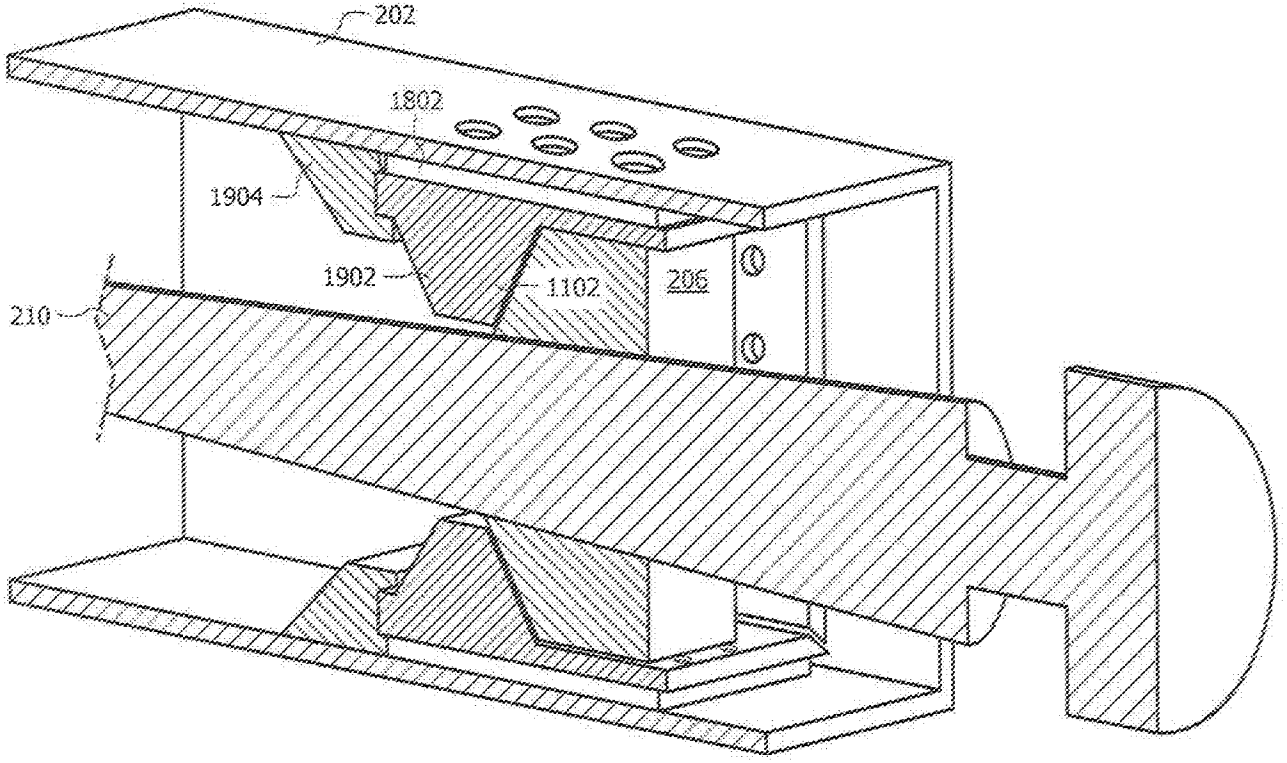
FIG. 19 is a partial cutaway view of a portion of another embodiment of a friction EOC assembly.

FIG. 19 is a partial cutaway view of a portion of another embodiment of a friction EOC assembly 200. In FIG. 19, the friction EOC assembly 200 is configured similar to the friction EOC assembly 200 described in FIG. 18. For example, the friction EOC assembly 200 comprises a low modulus material 1802 disposed between the sliding wedge segments 206 and the housing 202 similar to the low modulus material 1802 described in FIG. 18. In FIG. 19, the friction EOC assembly 200 comprise a semi-static block 1902 that is interlocked with a fixed shear backer 1904. In this configuration, the semi-static block 1902 is configured to provide the angled contact surface 1102 for the housing 202. The fixed shear backer 1904 is configured to prevent lateral movement of the semi-static block 1902 as the center shaft 210 traverses the housing 202.

One of ordinary skill in the art would appreciate that the various configurations of the friction EOC assembly 200 described in FIGS. 1-19 may be combined and/or used interchangeably with each other. For example, the friction EOC assembly 200 may comprise any suitable combination and configuration of components as described in FIGS. 1-19. In addition, one of ordinary skill in the art would appreciate that the configurations of the friction EOC assembly 200 described in FIGS. 1-19 may be used with the dampening method 1000 described in FIG. 10.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be mode without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A friction end-of-car cushioning assembly, comprising:
- a housing comprising a chamber formed within a bore of the housing, wherein the chamber comprises:
  - a first contact surface comprising an angled contact surface; and
  - a second contact surface at a second end of the chamber;
- a center shaft disposed at least partially within the bore of the housing, comprising:
  - a first end of the center shaft;
  - a second end of the center shaft; and
  - a rod portion spanning between the first end and the second end, wherein the rod portion is tapered from the second end of the center shaft to the first end of the center shaft;
- a sliding wedge disposed within the chamber, wherein the sliding wedge comprises:
  - a first contact surface tapered toward the first contact surface of the housing, wherein the first contact surface of the sliding wedge is positioned to apply a force onto the angled contact surface of the housing;
  - a second contact surface perpendicular to the bore of the housing; and
  - a third contact surface parallel to the bore of the housing, wherein the third contact surface of the sliding wedge is positioned to apply a frictional force to the rod portion of the center shaft; and
- a load spring disposed within the chamber, wherein:
  - the load spring is compressed between the second contact surface of the chamber and the second contact surface of the sliding wedge; and
  - the load spring is positioned to apply a compressive force onto the second contact surface of sliding wedge toward the angled contact surface of the chamber.

2. The assembly of claim 1, further comprising a draft spring positioned between the first end of the center shaft and a third contact surface of the chamber at the first end of the chamber.

3. The assembly of claim 1, further comprising a return spring positioned between the second end of the center shaft and a fourth contact surface of the chamber at the second end of the chamber.

4. The assembly of claim 1, further comprising an elastomer lining between the first contact surface of the sliding wedge and the angled contact surface of the housing.

5. The assembly of claim 1, further comprising an insert between the third contact surface of the sliding wedge and the rod portion of the center shaft.

6. The assembly of claim 1, wherein the load spring is configured to not further compress as the center shaft moves within the bore of the housing.

7. The assembly of claim 1, wherein:
- the rod portion comprises a first tapered portion and a second tapered portion; and the first tapered portion has a different taper rate than the second tapered portion.

8. The assembly of claim 1, wherein:

the angled contact surface of the housing is curved toward the sliding wedge; and the first contact surface of the sliding wedge is curved away from the angled contact surface of the housing.

9. The assembly of claim 1, wherein:

housing has a rectangular cross section;

the rod portion of the center shaft has a rectangular cross section; and the sliding wedge comprises a plurality of sliding wedge segments, wherein each sliding wedge segment is configured to apply a force to:

a corner in the rectangular cross section of the housing; and at least one edge of the rectangular cross section of the rod portion of the center shaft.

10. The assembly of claim 1, wherein:

housing has a rectangular cross section;

the rod portion of the center shaft has a rectangular cross section; and the sliding wedge comprises a plurality of sliding wedge segments, wherein each sliding wedge segment is configured to apply a force to:

an edge of the rectangular cross section of the housing; and at least one edge of the rectangular cross section of the rod portion of the center shaft.

11. A damping method, comprising:

configuring a friction end-of-car cushioning assembly on a railcar in a first configuration, wherein in the first configuration:

a center shaft comprises:

a first end of the center shaft;

a second end of the center shaft;

a rod portion spanning between the first end and the second end, wherein the rod portion is tapered from the second end to the first end; and a head portion positioned adjacent to a chamber formed within a bore of a housing;

the chamber comprises:

a first contact surface comprising an angled contact surface;

a second contact surface at a second end of the chamber; and a sliding wedge disposed within the chamber, wherein the sliding wedge comprises:

a first contact surface tapered toward the first contact surface of the housing, wherein the first contact surface of the sliding wedge is positioned to apply a force onto the angled contact surface of the chamber;

a second contact surface perpendicular to the bore of the housing; and a third contact surface parallel to the bore of the housing, wherein the third contact surface of the sliding wedge is positioned to apply a frictional force to the rod portion of the center shaft; and a load spring disposed within the chamber, wherein:

the load spring is compressed between the second contact surface of the chamber and the second contact surface of the sliding wedge; and the load spring is positioned to apply a compressive force onto the second contact surface of sliding wedge toward the angled contact surface of the chamber; and applying a force onto a coupler interface portion of the center shaft in a direction toward the first end of the chamber to transition the friction end-of-car cushioning assembly to a second configuration, wherein applying the force onto the center shaft:

moves the head portion of the center shaft away from the chamber; and moves the coupler interface portion of the center shaft toward the chamber.

12. The method of claim 11, wherein the friction end-of-car cushioning assembly further comprises a draft spring positioned between the head portion of the center shaft and a third contact surface of the chamber at the first end of the chamber.

13. The method of claim 11, wherein the friction end-of-car cushioning assembly further comprises a return spring positioned between the coupler interface of the center shaft and a fourth contact surface of the chamber at the second end of the chamber.

14. The method of claim 11, wherein the load spring is configured to not further compress as the center shaft moves within the bore of the housing.

15. The method of claim 11, wherein:

the rod portion comprises a first tapered portion and a second tapered portion; and the first tapered portion has a different taper rate than the second tapered portion.

16. The method of claim 11, wherein:

the angled contact surface of the housing is curved toward the sliding wedge; and the first contact surface of the sliding wedge is curved away from the angled contact surface of the housing.

17. A damping method, comprising:

configuring a friction end-of-car cushioning assembly on a railcar in a first configuration, wherein in the first configuration:

a center shaft comprises:

a first end of the center shaft;

a second end of the center shaft;

a rod portion spanning between the first end and the second end, wherein the rod portion is tapered from the second end to the first end; and a coupler interface portion of the center shaft positioned adjacent to a chamber formed within a bore of a housing;

the chamber comprises:

a first contact surface comprising an angled contact surface;

a second contact surface at a second end of the chamber;

a sliding wedge disposed within the chamber, wherein;

the sliding wedge comprises:

a first contact surface tapered toward the first contact surface of the housing, wherein the first contact surface of the sliding wedge is positioned to apply a force onto the angled contact surface of the chamber;

a second contact surface perpendicular to the bore of the housing; and a third contact surface parallel to the bore of the housing, wherein the third contact surface of the sliding wedge is positioned to apply a frictional force to the rod portion of the center shaft;

the sliding wedge is positioned to allow the rod portion of the center shaft to pass through a bore defined by the third contact surface of the sliding wedge; and a load spring disposed within the chamber, wherein:

the load spring is compressed between the second contact surface of the chamber and the second contact surface of the sliding wedge; and the load spring is positioned to apply a compressive force onto the second contact surface of sliding wedge toward the angled contact surface of the chamber; and applying a force onto the coupler interface portion of the center shaft in a direction away the first end of the chamber to transition the friction end-of-car cushioning assembly to a second configuration, wherein applying the force onto the center shaft:

moves a head portion of the center shaft toward from the chamber; and moves the coupler interface portion of the center shaft away the chamber.

18. The method of claim 17, wherein the load spring is configured to not further compress as the center shaft moves within the bore of the housing.

19. The method of claim 17, wherein:

the rod portion comprises a first tapered portion and a second tapered portion; and the first tapered portion has a different taper rate than the second tapered portion.

20. The method of claim 17, wherein:

the angled contact surface of the housing is curved toward the sliding wedge; and the first contact surface of the sliding wedge is curved away from the angled contact surface of the housing.

* * * * *